US010065228B2

(12) United States Patent
Huang et al.

(10) Patent No.: US 10,065,228 B2
(45) Date of Patent: Sep. 4, 2018

(54) COLLAPSIBLE SPACER AND SPACING METHOD FOR FORMING

(71) Applicant: Ford Motor Company, Dearborn, MI (US)

(72) Inventors: Liang Huang, Troy, MI (US); Evangelos Liasi, Royal Oak, MI (US)

(73) Assignee: Ford Motor Company, Dearborn, MI (US)

( * ) Notice: Subject to any disclaimer, the term of this patent is extended or adjusted under 35 U.S.C. 154(b) by 114 days.

(21) Appl. No.: 15/202,662

(22) Filed: Jul. 6, 2016

(65) Prior Publication Data

US 2018/0009018 A1 Jan. 11, 2018

(51) Int. Cl.
*B21D 22/02* (2006.01)

(52) U.S. Cl.
CPC ..... *B21D 22/022* (2013.01)

(58) Field of Classification Search
CPC ..... B21D 22/022; B21D 22/20; B21D 22/22; B21D 22/10; B21D 22/208; B21D 22/283; B21D 24/04; B21D 24/16; B21D 35/001; B21D 37/10; B21D 37/142
See application file for complete search history.

(56) References Cited

U.S. PATENT DOCUMENTS 4,509,355 A * 4/1985 Oishi ..... B21D 24/16 72/325
7,004,007 B2 2/2006 Kruger et al.
7,080,535 B2 7/2006 Kruger et al.
7,171,838 B2 2/2007 Shiokawa
9,038,431 B2 5/2015 Micklisch et al.
9,044,801 B2 6/2015 Golovashchenko et al.
2012/0282482 A1 11/2012 Flehmig et al.
2013/0205863 A1 8/2013 Loesch
2015/0266076 A1* 9/2015 Ueda ..... B21D 24/04 72/342.3

FOREIGN PATENT DOCUMENTS

CN 103111527 5/2013
CN 204685799 10/2015
DE 102011120789 A1 * 6/2013 ..... B21D 22/22

OTHER PUBLICATIONS

Machine translation of DE102011120789A1, Canti et al., pp. 1-5, translated on Dec. 21, 2017.*

* cited by examiner

*Primary Examiner* — Teresa M Ekiert
(74) *Attorney, Agent, or Firm* — Carlson, Gaskey & Olds, P.C.

(57) ABSTRACT

An exemplary die assembly includes a die member, a blankholder, and a collapsible spacer moveable back-and-forth between an extended position and a collapsed position. The collapsible spacer establishing a first gap between the die member and the blankholder in the extended position. The collapsible spacer establishing a second, smaller gap between the die member and blankholder in the collapsed position. An exemplary forming method includes maintaining a distance between a die member and a blankholder with a collapsible spacer when forming a workpiece into a desired shape, and collapsing the collapsible spacer to permit the die member and the blankholder to move closer together.

19 Claims, 4 Drawing Sheets

COLLAPSIBLE SPACER AND SPACING METHOD FOR FORMING

TECHNICAL FIELD

This disclosure relates generally to forming a workpiece and, more particularly, to a collapsible spacer that maintains a desired gap between forming tools at specified times during forming.

BACKGROUND

Forming processes manipulate a workpiece into a desired shape. In some forming processes, such as hot stamping, the workpiece is heated and placed in a die assembly. Portions of the die assembly are then actuated to form the workpiece into the desired shape. After forming, a quenching process cools the desired shape. Portions of the die assembly are then actuated again so that the desired shape can be removed from the die assembly.

When forming the workpiece into the desired shape, the die assembly can include a solid balance block to maintain a desired spacing between different areas of the die assembly. For example, the solid balance block could be placed between a blankholder and a die member to maintain a gap during forming for multiple reasons. Without the gap, the blankholder and die member could pinch the workpiece during forming. In hot-stamping, a pinch or full-contact condition in the early forming stage such as binder or pad closure can undesirably cause significant temperature gradients, which may cause the workpiece to fracture.

During the quenching process, the die assembly can be used to conduct thermal energy away from the desired shape. Good contact between the die assembly and the desired shape can facilitate the conducting. Some known die assemblies move areas of the die assembly closer together after forming in preparation for quenching, but the solid spacer maintains the gap between the blankholder and the die member.

SUMMARY

A die assembly according to an exemplary aspect of the present disclosure includes, among other things, a die member, a blankholder, and a collapsible spacer moveable back-and-forth between an extended position and a collapsed position. The collapsible spacer establishing a first gap between the die member and the blankholder in the extended position. The collapsible spacer establishing a second, smaller gap between the die member and blankholder in the collapsed position.

In a further non-limiting embodiment of the foregoing die assembly, the die assembly includes a stop configured to force the collapsible spacer to move from the extended position to the collapsed position.

In a further non-limiting embodiment of any of the foregoing die assemblies, the blankholder is configured to move together with the die member until the stop blocks movement of the blankholder and forces the collapsible spacer to move from the extended position to the collapsed position.

In a further non-limiting embodiment of any of the foregoing die assemblies, at least a portion of the collapsible spacer is disposed between the die member and blankholder.

In a further non-limiting embodiment of any of the foregoing die assemblies, comprising a cavity in the die member that receives a portion of the collapsible spacer, a cavity in blankholder that receives a portion of the collapsible spacer, or cavities in both the collapsible spacer and the blankholder that each receive a portion of the collapsible spacer.

In a further non-limiting embodiment of any of the foregoing die assemblies, the blankholder is disposed adjacent a post. The die member is configured to move together with the blankholder relative to the post to form a workpiece when the collapsible spacer is in the extended position. The die member is configured to move relative to the blankholder as the collapsible spacer is moved from the extended position to the collapsed position.

In a further non-limiting embodiment of any of the foregoing die assemblies, the die assembly includes a biasing support that biases the blankholder toward the die member when the collapsible member is in the extended position.

In a further non-limiting embodiment of any of the foregoing die assemblies, the biasing support is configured to exert a first biasing force and the collapsible member is configured to exert a second biasing force less than the first biasing force.

In a further non-limiting embodiment of any of the foregoing die assemblies, the die member is a post and the die assembly further includes a moveable die member separate from the post. The collapsible spacer supports the blankholder on the post, and a biasing support couples the blankholder to the moveable die member.

In a further non-limiting embodiment of any of the foregoing die assemblies, the collapsible spacer extends through an aperture in a workpiece that is held between the post and the moveable die member.

A forming method according to an exemplary aspect of the present disclosure includes, among other things, maintaining a distance between a die member and a blankholder with a collapsible spacer when forming a workpiece into a desired shape, and collapsing the collapsible spacer to permit the die member and the blankholder to move closer together.

In a further non-limiting embodiment of any of the foregoing forming methods, the die member is a first die member, and the moving comprises moving the first die member and the blankholder relative to a second die member and forming the workpiece over the second die member during the moving.

A further non-limiting embodiment of any of the foregoing forming methods includes quenching the workpiece after the collapsing A further non-limiting embodiment of any of the foregoing forming methods includes starting the collapsing by blocking movement of the blankholder.

In a further non-limiting embodiment of any of the foregoing forming methods, the forming method includes supporting the second die during the maintaining with a biasing support having a first biasing force, and maintaining the distance with the collapsible spacer having a second biasing force greater than the first biasing force.

A further non-limiting embodiment of any of the foregoing forming methods includes starting the collapsing by directly contacting the blankholder with a stop of the die member.

A further non-limiting embodiment of any of the foregoing forming methods includes supporting the blankholder during the maintaining with a biasing member having a first biasing force, and maintaining the distance with the collapsible spacer having a second biasing force greater than the first biasing force.

In a further non-limiting embodiment of any of the foregoing forming methods, the die member is a post and the method further includes starting the collapsing by contacting the blankholder with a stop that moves toward the post during the forming.

A further non-limiting embodiment of any of the foregoing forming methods includes moving a moveable die member toward the post during the forming relative to a blankholder and the post, and forming the workpiece over the post during the moving.

A further non-limiting embodiment of any of the foregoing forming methods includes supporting the blankholder on the post with the collapsible member.

A further non-limiting embodiment of any of the foregoing forming methods includes supporting the blankholder with a biasing support secured relative to the moveable die member and the blankholder.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a forming a workpiece into a desired shape using a die assembly. More particularly, the disclosure relates to a collapsible spacer utilized during the forming process.

Figure 1:
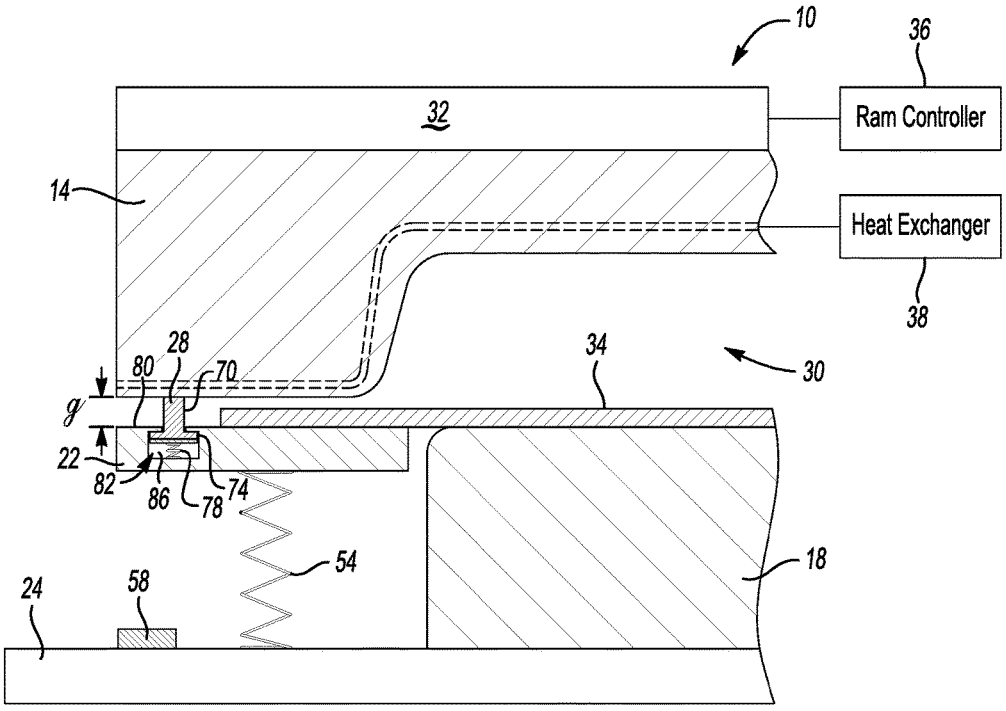
FIG. 1 illustrates an example die assembly and a workpiece at an initial position prior to forming.
Figure 2:
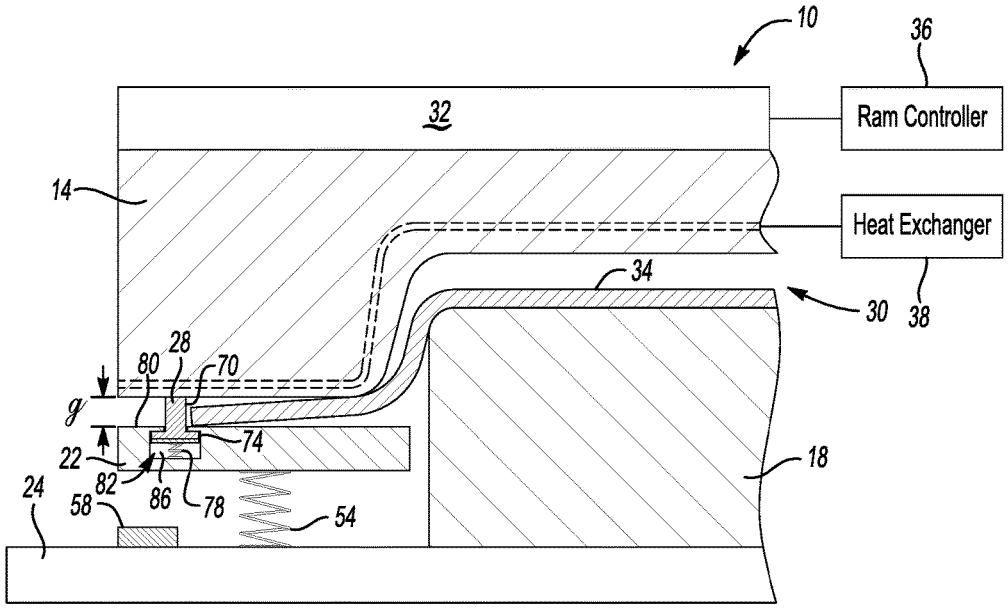
FIG. 2 illustrates the die assembly of FIG. 1 at an intermediate position when forming the workpiece into a desired shape.
Figure 3:
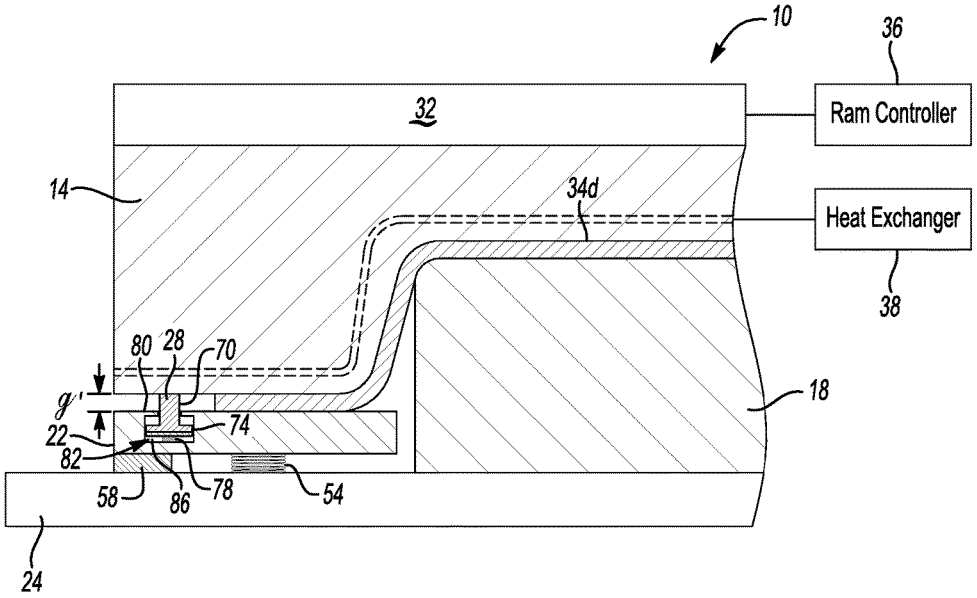
FIG. 3 illustrates the die assembly of FIG. 2 when quenching the desired shape after forming.

Referring to FIGS. 1-3, an example die assembly 10 includes a first die member 14, a second die member 18, a blankholder 22, a base 24, and a collapsible spacer 28. During forming, the collapsible spacer 28 maintains a first gap between portions of the die assembly 10, and then collapses to maintain a smaller, second gap. Moving portions of the die assembly 10 closer together can ensure that the die assembly 10 maintains good contacts with the desired shape when cooling the desired shape after forming.

In this example, the first die member 14 provides a cavity 30. During a forming process, a ram 32 forces the first die member 14 to move toward the second die member 18 from the position of FIG. 1 to the position of FIG. 3 where the second die member 18 is received within the cavity 30. The first die member 14 can be considered a moveable die member in this example, and the second die member 18 can be considered a post.

A ram controller 36 is operably coupled to the ram 32. The ram controller 36 can be programmed to control the stroke of the ram 32 back and forth between the position of FIG. 1 and the position of FIG. 3. The ram controller 36 provides inputs to actuators that stroke the ram 32. In this example, the ram 32 is driven with mechanical actuators. In another example, the ram 32 is hydraulically driven.

The second die member 18 is supported directly on the base 24 and remains stationary relative to the first die member 14 as the ram 32 moves the first die member 14 toward the second die member 18.

A workpiece 34 is positioned between the first die member 14 and the second die member 18. The forming process moves the first die member 14 toward the second die member 18 to form the workpiece 34 into a desired shape 34*d* (FIG. 3). Non-limiting examples of the desired shape 34*d* could include an exterior vehicle panel.

At the start of the forming process, the workpiece 34 is loaded into the die assembly 10 as shown in FIG. 1. The example forming process is a hot stamping process where the workpiece 34 is heated prior to being loaded into the die assembly 10. In some examples, the workpiece 34 is a boron steel blank heated within a furnace to an austenitic state, such as more than 900 degrees Celsius, and then loaded into the die assembly 10.

The blankholder 22 and the second die member 18 support the workpiece 34 during forming. A portion of the workpiece 34 is between the first die member 14 and the blankholder 22, and a portion of the workpiece 34 spans the cavity 30 between the first die member 14 and the second die member 18. For purposes of this disclosure, the blankholder 22 can be any component used to hold the workpiece 34, e.g., a binder, ring, lower pad, upper pad, etc.

After loading, the first die member 14 moves toward the second die member 18 to form the workpiece 34 into the desired shape 34*d*. During forming, some material of the workpiece 34 may be drawn from outside the cavity 30 to inside the cavity 30.

In some examples, a temperature of the workpiece 34 can decrease to about 600 degrees Celsius during forming. Even though the workpiece 34 cools during forming, further cooling may be required. In this example, the workpiece 34 is formed into the desired shape 34*d* and then cooled within the die assembly 10. Cooling the desired shape 34*d* prior to removal from the die assembly 10 can enhance quality of the desired shape 34*d*.

A quenching process is used to cool the desired shape 34*d* in this example. As shown in FIG. 3, during quenching, a coolant is circulated from a heat exchanger 38 through passageways of the first die member 14. The coolant can be water, for example.

The coolant accepts thermal energy from the desired shape 34*d* and the first die member 14 to cool the desired shape 34*d*. The heat exchanger 38 exchanges thermal energy in the heated coolant with ambient air, for example. Although shown as circulating through the first die member 14, the coolant could instead, or additionally, be circulated through other areas of the die assembly 10.

After the quenching, the first die member 14 is moved away from the second die member 18 and the desired shape 34*d* is removed from the die assembly 10. In some examples, the quenching process associated with the teachings of this disclosure can cool the desired shape 34*d* at a rate greater than 30 degrees Celsius per second.

Contact between the desired shape 34*d* and the die assembly 10 can facilitate cooling the desired shape 34*d*. Good contact can, for example, ensure that thermal energy is conducted away from the desired shape 34*d* into the die assembly 10 and into the coolant.

Figure 4:
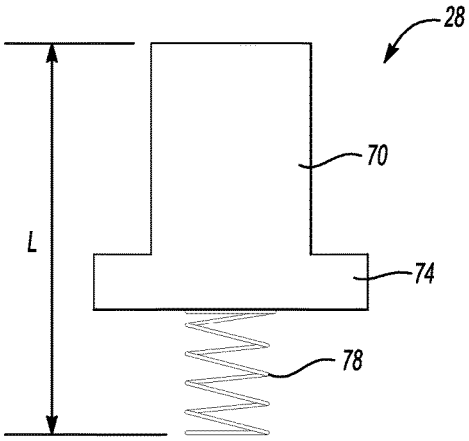
FIG. 4 illustrates a collapsible member from the die assembly of FIG. 1-3 in an extended position.
Figure 5:
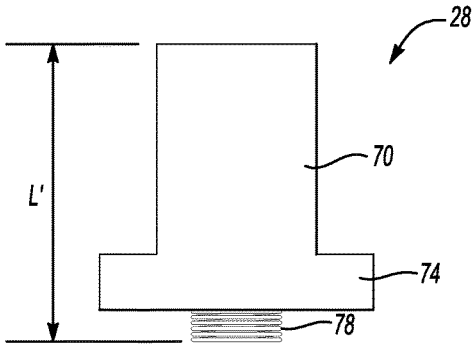
FIG. 5 illustrates a collapsible member from the die assembly of FIG. 1-3 in a collapsed position.

Referring now to FIGS. 4 and 5 with continuing reference to FIGS. 1-3, the collapsible spacer 28 in the extended position has a length L to maintain a gap g between the first die member 14 and the blankholder 22 during forming. In the collapsed position, the collapsible spacer 28 has a length L' to maintain a gap g' between the first die member 14 and the blankholder 22 during quenching. The gap g' is smaller than the gap g. The die assembly 10 can thus maintain a desired gap during forming and a different, desired gap during cooling. The gap g permits material flow during forming whereas the smaller gap g' ensures good contact between the desired shape 34*d* and the die assembly 10 during cooling.

In this example, the collapsible spacer 28 exerts a biasing force urging the blankholder 22 away from the first die member 14. The collapsible spacer 28 is positioned between the first die member 14 and the blankholder 22 in this example.

The blankholder 22 is supported by a support 54 that exerts a biasing force urging the blankholder 22 toward the first die member 14. The support 54 can be a conventional spring, a nitrocylinder, or another type of biasing support.

The biasing force exerted by the collapsible spacer 28 is greater than the biasing force exerted by the support 54. Thus, the blankholder 22 is spaced the gap g from the first die member 14 at the start of forming as shown in FIG. 1 and during the forming process as shown in FIG. 2.

When the first die member 14 has moved to the position of FIG. 3, the movement of the first die member 14 forces the blankholder 22 against a stop 58. The stop 58 prevents further movement of the blankholder 22 toward the base 24. The ram 32, however, continues to force the first die member 14 toward the base 24. The force exerted by the ram 32 overcomes the biasing force of the biasing member 78, which moves the collapsible spacer 28 to the collapsed position of FIG. 3 and permits the first die member 14 to move closer to the blankholder 22. The gap g shown in FIGS. 1 and 2 is thus reduced to the gap g' shown in FIG. 3.

Due to the reduction in the gap, the desired shape 34*d* is held more tightly between the first die member 14 and the blankholder 22 after forming than during forming. This ensures good contact between the first die member 14 and the desired shape 34*d*, and further ensures good contact between the blankholder 22 and the desired shape 34*d*. The contact can facilitate transfer of thermal energy from the desired shape 34*d* to the workpiece 34.

In this example, the collapsible spacer 28 includes a primary portion 70, a flange 74 extending from the primary portion 70, and a biasing member 78. The biasing member 78 can be a conventional spring, a nitrocylinder, or another type of biasing member.

The example collapsible spacer 28 is partially received within a cavity 82 provided within the blankholder 22. In another example, a portion of the collapsible spacer 28 is held instead, or additionally, within a cavity provided by the first die member 14.

When the collapsible spacer 28 is in the extended position of FIGS. 1 and 2, the biasing member 78 forces the flange 74 into contact with a lip 80. The contact ensures that a desired amount of the primary portion 70 extends past the blankholder 22 toward the first die member 14 and controls a size of the gap g.

When the blankholder 22 contacts the stop 58 as shown in FIG. 3, further movement of the first die member 14 toward the blankholder 22 overcomes the biasing force of the biasing member 78 and collapses the biasing member 78. The collapsible spacer 28 then bottoms out against a floor 86 of the cavity.

In some examples, the ram 32 presses the first die member 14 further toward the base 24 after forming. This changes the gap g to the gap g' between the first die member 14 and the blankholder 22, and also reduces the distance between the first die member 14 and the second die member 18 within the cavity 30. The difference between the gap g and the gap g' may be only a few tenths of a millimeter, but the reduction is sufficient to ensure that the die assembly 10 positively contacts the desired shape 34*d*.

After the workpiece 34 has been formed into the desired shape as shown in FIG. 3, the first die member 14 is moved away from the second die member 18, which causes the collapsible spacer 28 to move from the collapsed position shown in FIG. 3 back to the extended position as shown in FIGS. 1 and 2. After the first die member 14 has been moved sufficiently away from the second die member 18, the desired shape 34*d* is removed from the cavity 30.

In some examples, the collapsible spacer 28 comprises a cylinder that can be adjusted in response to an input from a controller to control a gap between the first die member 14 and the blankholder 22. The cylinder could, for example, be a programmable nitrogen cylinder. The ram controller 36, or another controller, could provide the input to the cylinder. In examples wherein the collapsible spacer 28 is a cylinder, the collapsible spacer 28 does not necessarily rely on the blankholder 22 contacting the stop 58 to move the collapsible spacer 28 from an extended position to a retracted position. Instead, the controller commands the cylinder to move from an extended position to a retracted position to close the gap between the first die member 14 and the blankholder 22, or otherwise adjust the gap as the ram 32 is stroked.

Figure 6:
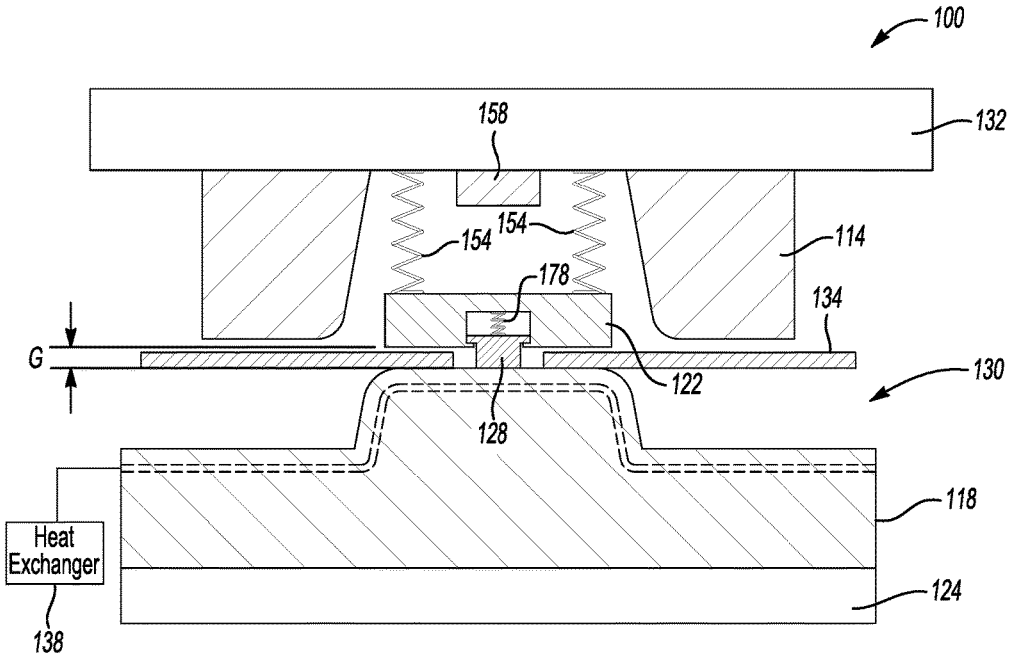
FIG. 6 illustrates another example die assembly and a workpiece.
Figure 7:
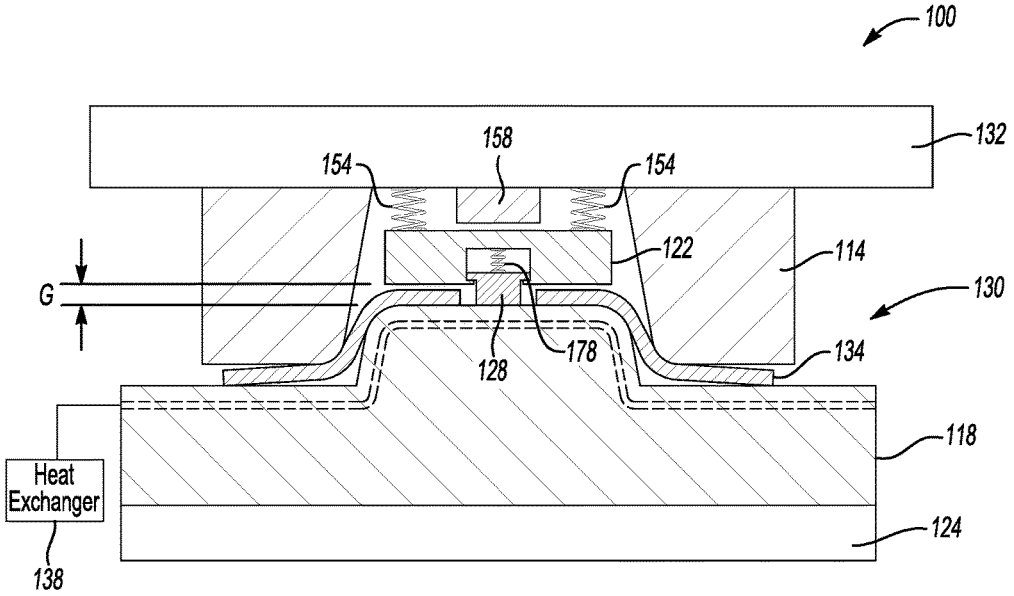
FIG. 7 illustrates the die assembly of FIG. 6 when forming the workpiece into a desired shape.
Figure 8:
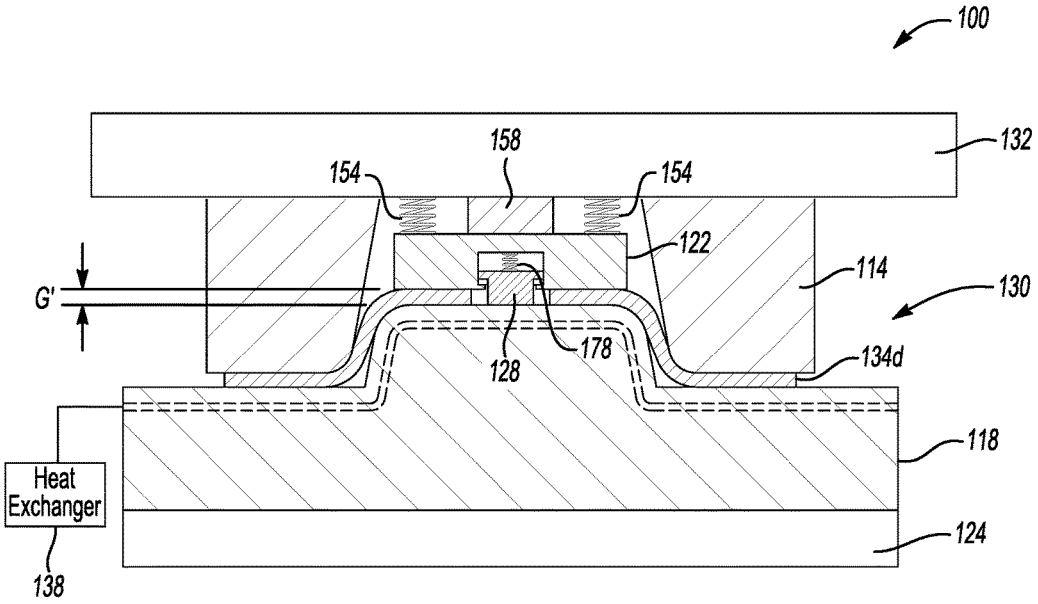
FIG. 8 illustrates the die assembly FIG. 6 after forming.

Referring now to FIGS. 6-8, another example die assembly 100 includes a first die member 114, a second die member 118, and a blankholder 122. The second die member 118 is supported on a base 124. The second die member 118 provides a cavity 130. During forming, a ram 132 moves the first die member 114 toward the cavity 130 to form a workpiece 134 into a desired shape 134*d* (FIG. 8). The first die member 114 can be considered an upper die in this example, and the second die member 118 a post.

At least one biasing support 154 secures the blankholder 122 to the first die member 114. A collapsible spacer 128 supports the blankholder 122 on the second die member 118. The collapsible spacer 128 is shown being received within an aperture of the workpiece 134. The collapsible spacer 128 could instead be located outside an outer perimeter of the workpiece 134.

During forming, a biasing portion 178 of the collapsible spacer 128 forces the collapsible spacer 128 into an extended position. A portion of the workpiece 134 is held within the gap G during forming. The collapsible spacer 128 in the extended position maintains a gap G between the second die member 118 and the blankholder 122.

During the forming, the first die member 14 moves toward the blankholder 122 and the second die member 118 from the position of FIG. 6 to the position of FIG. 8 where the workpiece 134 is formed into the desired shape 134*d*.

In the position of FIG. 8, a stop 158 moving with the ram 132 has contacted the blankholder 122. Through the stop 158, movement of the ram 132 toward the second die member 118 overcomes the biasing force exerted by the biasing portion 178 of the collapsible spacer 128. The force exerted by the stop 158 on the blankholder 122 causes the collapsible spacer 128 to move from the extended position to a collapsed position. When the collapsible spacer 128 is in the collapsed position the space between the blankholder 122 and the second die member 118 has been reduced from a gap G to a gap G'. The areas of the workpiece between the blankholder 122 and the second die member 118 are thus more tightly held when the collapsible spacer 128 has moved to the collapsed position of FIG. 8.

When the die assembly 100 is in the position of FIG. 8, a quenching process can cool the desired shape 134*d*. Since the gap G' is smaller than the gap G, good thermal contact between the blankholder 122 and the second die member 118 is maintained during the quenching process, which can include moving coolant between a heat exchanger 138 and the second die member 118, or between the heat exchanger 138 and another portion of the die assembly.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A die assembly, comprising:

a die member;

a blankholder;

a collapsible spacer moveable back-and-forth between an extended position and a collapsed position, the collapsible spacer in the extended position establishing and maintaining a first gap to hold a workpiece between the die member and the blankholder, the collapsible spacer in the collapsed position establishing a second, smaller gap to hold the workpiece between the die member and blankholder, wherein at least a portion of the collapsible spacer is disposed between the die member and blankholder; and a stop configured to force the collapsible spacer to move from the extended position to the collapsed position.

2. The die assembly of claim 1, wherein the blankholder is configured to move together with the die member until the stop blocks movement of the blankholder and forces the collapsible spacer to move from the extended position to the collapsed position.

3. The die assembly of claim 1, comprising a cavity in the die member that receives a portion of the collapsible spacer, a cavity in blankholder that receives a portion of the collapsible spacer, or cavities in both the collapsible spacer and the blankholder that each receive a portion of the collapsible spacer.

4. The die assembly of claim 1, wherein the blankholder is disposed adjacent a post, the die member configured to move together with the blankholder relative to the post to form the workpiece when the collapsible spacer is in the extended position, the die member configured to move relative to the blankholder as the collapsible spacer is moved from the extended position to the collapsed position.

5. The die assembly of claim 4, comprising a biasing support that biases the blankholder toward the die member when the collapsible member is in the extended position.

6. The die assembly of claim 5, wherein the biasing support is configured to exert a first biasing force and the collapsible member is configured to exert a second biasing force less than the first biasing force.

7. The die assembly of claim 1, wherein the die member is a post and the die assembly further comprises a moveable die member separate from the post, wherein the collapsible spacer supports the blankholder on the post, and a biasing support couples the blankholder to the moveable die member.

8. The die assembly of claim 7, wherein the collapsible spacer extends through an aperture in the workpiece that is held between the post and the moveable die member.

9. The die assembly of claim 1, further comprising a biasing support that biases the blankholder toward the die member when the collapsible member is in the extended position.

10. A forming method, comprising:

maintaining a gap between a die member and a blankholder with a collapsible spacer when forming a workpiece into a desired shape, a portion of the workpiece held within the gap during the forming;

collapsing the collapsible spacer to permit the die member and the blankholder to move closer together and reduce the gap; and starting the collapsing by blocking movement of the blankholder.

11. The forming method of claim 10, wherein the die member is a first die member, and the forming comprises moving the first die member and the blankholder relative to a second die member and forming the workpiece over the second die member during the moving.

12. The forming method of claim 10, comprising quenching the workpiece after the collapsing.

13. The forming method of claim 10, comprising supporting the blankholder during the maintaining with a biasing support having a first biasing force, and maintaining the gap with the collapsible spacer having a second biasing force greater than the first biasing force.

14. The forming method of claim 10, wherein the portion is held more tightly between the die member and the blankholder after the collapsing than before the collapsing.

15. The forming method of claim 10, wherein blocking movement of the blankholder comprises moving the blankholder against a stop that moves relatively toward the blankholder during the forming.

16. A forming method, comprising:

maintaining a distance between a die member and a blankholder with a collapsible spacer when forming a workpiece into a desired shape;

collapsing the collapsible spacer to permit the die member and the blankholder to move closer together, wherein the die member is a post; and starting the collapsing by contacting the blankholder with a stop that moves relatively toward the post during the forming.

17. The forming method of claim 16, comprising moving a moveable die member toward the post during the forming relative to a blankholder and the post, and forming the workpiece over the post during the moving.

18. The forming method of claim 17, comprising supporting the blankholder on the post with the collapsible member.

19. The forming method of claim 18, comprising further supporting the blankholder with a biasing support secured relative to the moveable die member and the blankholder.

* * * * *